United States Patent [19]

Grant

[11] 4,146,045

[45] Mar. 27, 1979

[54] CRUTCH CARRY-ALL ATTACHMENT

[76] Inventor: Donald A. Grant, 14304 Minya La., Poway, Calif. 92064

[21] Appl. No.: 839,024

[22] Filed: Oct. 3, 1977

[51] Int. Cl.[2] ..... A61H 3/02

[52] U.S. Cl. ..... 135/66; 135/68; 248/205 R; 248/311.1 R

[58] Field of Search ..... 135/66, 68; 248/205 R, 248/211, 220.2, 311.1, 441 B, 441 C; 224/0.5, 25 R

[56] References Cited

U.S. PATENT DOCUMENTS

| | | | |
|---|---|---|---|
| 2,311,049 | 2/1943 | Hedden | 135/68 |
| 2,423,635 | 7/1947 | Blum | 135/66 X |
| 2,553,730 | 5/1951 | Taylor | 135/66 X |
| 2,640,596 | 6/1953 | Reeder | 248/311.1 X |
| 2,912,991 | 11/1959 | Shinn | 135/66 X |
| 3,985,148 | 10/1976 | Cadman | 135/66 |

*Primary Examiner*—Ernest R. Purser
*Assistant Examiner*—Conrad L. Berman
*Attorney, Agent, or Firm*—Joseph R. Dwyer

[57] ABSTRACT

A crutch carry-all attachment for holding letters, papers, cigarettes, pocket radios, pencils and the like, of unitary preferably all plastic construction having outwardly opening grooves which engage the side rails of a crutch to removably secure the attachment in place.

3 Claims, 4 Drawing Figures

CRUTCH CARRY-ALL ATTACHMENT

BACKGROUND OF THE INVENTION

1. Field of the Invention

The present invention relates to crutch attachments for providing convenient means for handicapped users of a crutch.

2. Description of the Prior Art

The prior art crutch carry-all attachments for holding letters, papers, books, etc. usually include separate attaching means for attaching to the crutch, and/or require modifications of the crutch to secure the attachment thereto. Additionally, the prior art attachments are formed of several pieces including separate side walls, hinges, doors, magnetics and the like; all of which contribute to the cost of the attachment. Too, these numerous pieces make it difficult for a crutch user to manipulate so that in general the prior art attachments have been not only unacceptable but costly.

It is an object of this invention to overcome all of the deficiencies of the prior art attachments and provide a single unitary one piece preferably all plastic attachment so constructed and arranged to a crutch without tools and without modification of existing crutches and yet provide a simple convenient carry-all for a user.

A secondary object of this invention is to provide a carry-all attachment for a crutch which is inexpensive and of simplified construction so as to be commercially feasible.

SUMMARY OF THE INVENTION

The crutch attachment which overcomes the deficiencies of the prior art and meets the foregoing objects comprises an attachment of one piece construction of a thickness substantially the thickness of the crutch rails and of a width so as to be disposed between conventional crutch rails and provided with a central opening or compartment of papers, letters, magazines, pocket radios and the like, and further provided with an additional compartment for cigarettes and the like. The attachment is characterized in its simplicity and one piece construction so as to be made of a suitable plastic which can be molded inexpensively and thus be more commercially feasible than the prior art devices.

After a review of the following description additional objects and advantages of the invention will be apparent to those skilled in the art.

DESCRIPTION OF THE PREFERRED EMBODIMENT

Figure 1:
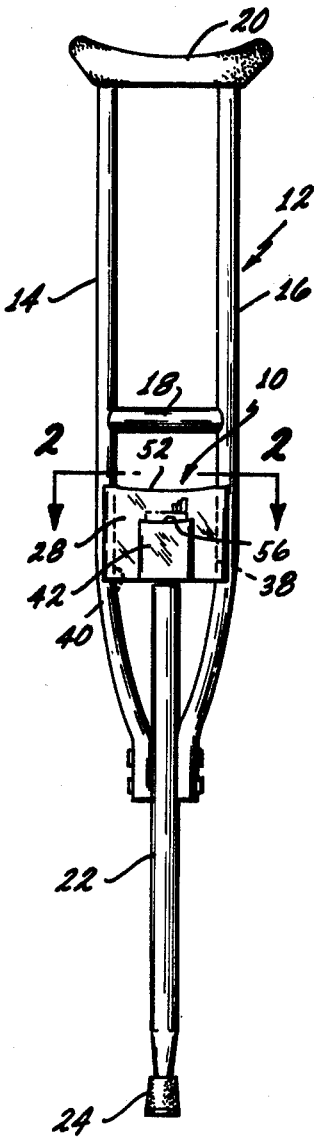
FIG. 1 is a front elevational view of the invention shown attached to a standard commercially available crutch.

Referring now to the drawings in detail, the carry-all is indicated in its entirety as 10 and is adapted for use with a crutch 12 having a pair of side rails 14 and 16, a handle 18 extending between and secured to the side rails and a padded support 20 for engagement in the arm pit of the user. The side rails 14 and 16 converge below the handle 18 to engage a leg 22 which is secured therebetween by any suitable means, conventionally a bolt arrangement. Bolt holes are also provided in the leg 22 to adjust the height of the crutch and crutch tip 24 is positioned on the lower end of the leg 22 to absorb some of the shock of use of the crutch as well as to provide an anti-slip contact with the ground. The crutch 12, as is apparent is of conventional design and varies slightly in accordance with the needs of the user and the manufacturer.

Figure 2:
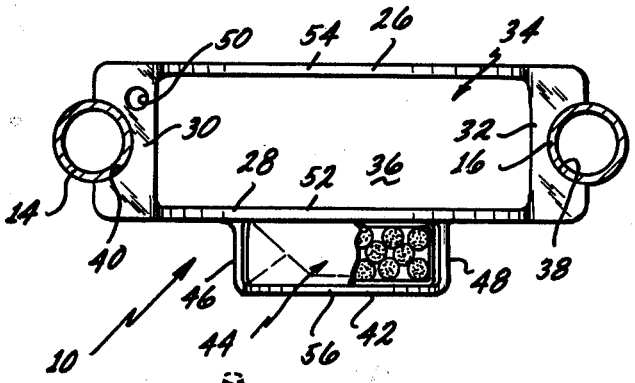
FIG. 2 is a top view, enlarged over that of FIG. 1, and taken along line 2—2 of FIG. 1 and looking in the direction of the arrows.
Figure 4:
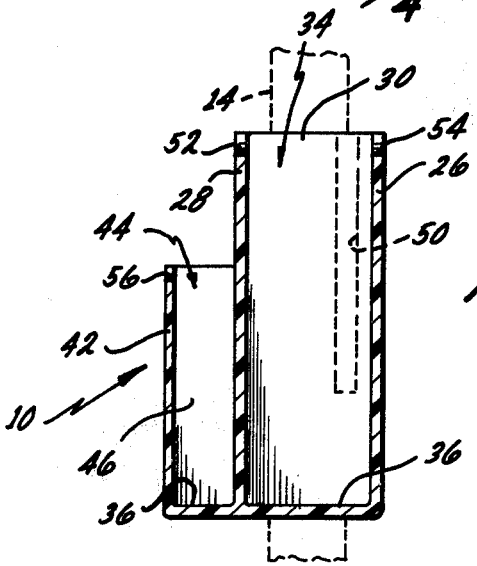
FIG. 4 is a cross-sectional view taken along line 4—4 of FIG. 3 and showing the inner details of the attachment.

Turning now specifically to the attachment 10 itself, it can be seen that the carry-all is of a one piece construction with substantially rectangular relatively thin back and front walls 26 and 28 disposed parallel to one another and spaced apart a distance greater than the standards 14 and 16 by a pair of thicker end walls 30 and 32 so as to define a compartment 34. In the illustrated embodiment, the compartment or cavity is greater than the diameter of the standards themselves as seen in FIG. 2, is open at the top and closed by a bottom wall 36 (FIG. 4). The end walls 30 and 32 are thick enough to extend outwardly substantially half way of the diameter of the standards as seen in FIG. 2 and are provided with outwardly extending grooves or channels which frictionally engage the standards 14 and 16 to removeably attach the attachment to the crutch.

Figure 3:
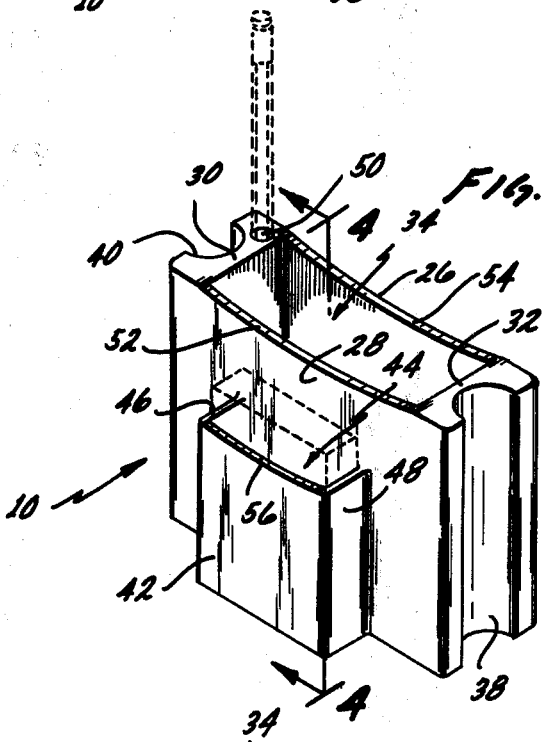
FIG. 3 is a perspective view showing the carry-all attachment itself separate and apart from the crutch.

The attachment 10 is also formed with an additional pocket or cavity 44 formed integral with the remainder of the attachment and comprises an additional front wall 42 and a pair of side walls 46 and 48 which space the front wall a distance to define the pocket 44 which is enclosed at the bottom by the bottom wall 36 which extends, as can be seen in FIG. 4, from the back wall 26 to the pocket wall 42 in the area where the additional pocket exists. This latter is more clearly seen in FIG. 3. Also, at least one side wall may be provided with a bore or hole 50 of a selected depth, such as a little more than half way from the top of the attachment to the bottom wall as illustrated in dotted line in FIG. 4, for a pencil or other articles; a pencil being shown in FIG. 3 in phantom.

From the foregoing description, it can be seen that the attachment 10 is designed to be placed within a crutch and the grooves 38 and 40 are spaced apart so as to enable a user to insert the attachment in the crutch where the standards are generally parallel after having loosened the adjusting bolts holding the leg 22 within the standards so the standard can be spread apart slightly and to slip the grooves within the standards 14 and 16. Then, after again tightening the standards to the leg 22 by the bolt arrangement, the attachment is moved downwardly until the standards frictionally engage the grooves thereby holding the attachment in the crutch. Removal of the attachment will be simply the reverse of the attaching proceedure.

As can be seen from the foregoing description, there is disclosed a simple one piece construction, preferably plastic attachment, having a compartment such as 34 for a number of articles such as envelopes, a radio, eyeglasses and the like and an additional compartment for any suitable item, a package of cigarettes being shown. Finally, for convenience in removal of articles from the compartments, the top edges of compartment 34 are curved as at 52 and 54 and similarly the top of the front wall 42 is curved as at 56.

What is claimed is:

1. A plastic crutch carry-all of unitary construction for attachment to a crutch of a type having a pair of spaced apart side rails which converge inwardly and are attached to a leg secured therebetween and extending downwardly therefrom comprising;

means defining a central main compartment including a pair of back and front parallely disposed relatively thin side walls spaced apart by a pair of relatively thick end walls said main compartment being substantially within said rails when attached to said crutch so that stored items in said compartment are generally within the confines of said crutch, means for securing said carry all to said side rails comprising outwardly extending grooves defined by extensions of said side walls adapted to conform to the contour of said side rails and made as integral extensions of said end walls, the width of said end walls being greater than the width of said side rails so that said grooves may encompass a portion of said side rails;

the distance between said grooves being such that they engage the side rails as they converge towards the legs to be removably attached to said rails; and means for closing said main compartment including a bottom wall.

2. The attachment as claimed in claim 1 further including:

means defining a second compartment one wall of which is integral with the front wall of said main compartment and whose side walls extend from said front wall and are integral therewith.

3. The attachment as claimed in claim 2 where at least one of said side walls is provided with a vertically extending bore for the reception of pencils and like articles.

* * * * *